US006283878B1

(12) United States Patent
White

(10) Patent No.: US 6,283,878 B1
(45) Date of Patent: Sep. 4, 2001

(54) ADJUSTABLE HEIGHT BASKETBALL APPARATUS

(75) Inventor: Ronald A. White, N. Prairie, WI (US)

(73) Assignee: Huffy Corporation, Miamisburg, OH (US)

( * ) Notice: Subject to any disclaimer, the term of this patent is extended or adjusted under 35 U.S.C. 154(b) by 0 days.

(21) Appl. No.: 09/266,005

(22) Filed: Mar. 11, 1999

(51) Int. Cl.[7] ..... A63B 63/08
(52) U.S. Cl. ..... 473/484; 473/479
(58) Field of Search ..... 473/484, 479, 473/476, 485

(56) References Cited

U.S. PATENT DOCUMENTS

| | | | |
|---|---|---|---|
| D. 350,797 | | 9/1994 | Curtis . |
| 532,132 | | 1/1895 | Zaremba . |
| 1,988,037 | | 1/1935 | Fürrer . |
| 2,379,572 | | 7/1945 | Gibson . |
| 2,986,395 | | 5/1961 | Sheftel . |
| 3,017,183 | | 1/1962 | Chalcroft . |
| 3,329,427 | | 7/1967 | Bearson . |
| 3,341,197 | | 9/1967 | Bottorff . |
| 4,793,611 | | 12/1988 | Thornell . |
| 5,082,261 | | 1/1992 | Pelfrey . |
| 5,133,547 | | 7/1992 | Pardi . |
| 5,211,393 | | 5/1993 | Rolffs et al. . |
| 5,375,835 | | 12/1994 | Van Nimwegen et al. . |
| 5,377,976 | | 1/1995 | Matherne et al. . |
| 5,401,015 | | 3/1995 | Woodall . |
| 5,462,269 | | 10/1995 | Schroeder et al. . |
| 5,465,957 | * | 11/1995 | Schroeder ..... 473/484 |
| 5,478,068 | | 12/1995 | Schroeder . |
| 5,503,390 | * | 4/1996 | Hall ..... 473/484 |
| 5,540,429 | | 7/1996 | Dalebout et al. . |
| 5,601,284 | | 2/1997 | Blackwell et al. . |
| 5,695,417 | * | 12/1997 | Winter et al. ..... 473/484 |
| 5,720,679 | * | 2/1998 | Schroeder ..... 473/484 |
| 5,772,167 | | 6/1998 | Koole . |
| 5,800,296 | | 9/1998 | Shaw . |
| 5,823,898 | | 10/1998 | Wang . |
| 5,826,846 | | 10/1998 | Buccieri et al. . |
| 5,879,247 | | 3/1999 | Winter et al. . |

FOREIGN PATENT DOCUMENTS 908055 10/1962 (GB) .

* cited by examiner

*Primary Examiner*—Jeanette Chapman
*Assistant Examiner*—M. Chambers
(74) *Attorney, Agent, or Firm*—Howrey Simon Arnold & White; Michael J. Bell

(57) ABSTRACT

An adjustable basketball apparatus having a basketball backboard, a support member or pole, and upper arm and a lower arm connecting the basketball backboard to the support member which, together with the backboard and support member, form a deformable parallelogram. There is a connecting rod disposed between one of the upper and lower arm and a locking device for holding the basketball backboard at a selected height. An inner bracket extends along the length of the connecting rod for preventing disengagement of the locking device. The connecting rod terminates in a first handle and the inner bracket terminates in a second handle such that when the first handle and the second handle are compressed, the locking device releases allowing the deformable parallelogram to be deformed, thereby adjusting the height of the basketball backboard.

14 Claims, 5 Drawing Sheets

ADJUSTABLE HEIGHT BASKETBALL APPARATUS

BACKGROUND OF THE INVENTION

1. Field of the Invention

The invention relates generally to a basketball apparatus. More particularly, the invention relates to basketball apparatuses with adjustable height backboards.

2. Description of Related Art

Various types of basketball apparatuses have been proposed and used in the past. Such proposals have recognized that adjustability of the height of the basketball goal is a desirable characteristic.

In some basketball adjustment systems, once the basketball goal is at the desired height, it is secured in place by tightening one or more bolts which "lock" the assembly in place. One of the disadvantages of such devices is that whenever one desires to adjust the basketball goal, it requires the use of a ladder to enable one to reach the bolts that must be loosened to "unlock" the basketball goal. This is complicated by the fact that when the bolt or bolts are loosened, the person adjusting the goal must support the entire weight of the goal until the goal has been to the desired height and the bolts are tightened.

There are also basketball apparatuses with adjustable height support poles. The poles are adjustable in a variety of ways, but none of the existing systems provide the user with sufficient leverage to make the adjustment in a simple manner. For example, there are systems which comprise telescoping support poles that are secured in place by a sleeve or collar on the support pole. Many of the pole-adjusting systems require the person making the adjustments to bear the entire weight of the basketball backboard and goal, as well as a substantial portion of the support pole, while making the desired adjustments.

Other adjustable basketball apparatuses have adjustment systems that are only accessible with the use of a ladder or require the person adjusting the goal to use a long rod or pole to manipulate the adjustment system. Moreover, many of these systems may also require the person adjusting the goal to support the entire weight of the goal while it is being adjusted.

The foregoing basketball apparatuses are typically adjusted to any height within the range of motion of the assemblies. There are not specified intervals in which the basketball goal is locked in place at a known height. If the user desires to move the basketball goal to a specific height, a tape measure or some such measuring device would be required. Such a method would be difficult and cumbersome to accomplish.

The foregoing demonstrates that there is a need for an adjustable height basketball apparatus that is easily adjusted with minimal effort and without the need for tools or equipment.

SUMMARY OF THE INVENTION

Additional features and advantages of the invention will be set forth in the description which follows, and in part will be apparent from the description, or may be learned by practice of the invention. The objectives and other advantages of the invention will be realized and attained by the apparatus particularly pointed out in the written description and claims hereof as well as the appended drawings.

To achieve these and other advantages and in accordance with the purpose of the invention, as embodied and broadly described, the invention consists of an adjustable basketball apparatus having a basketball backboard, a support member or pole, and an upper and lower arm, connected such that they form a deformable parallelogram. There is a connecting rod disposed between the deformable parallelogram and a locking device for holding the basketball backboard at a selected height. An inner bracket extends along the length of the connecting rod for preventing disengagement of the locking device. The connecting rod terminates in a first handle and the inner bracket terminates in a second handle such that when the first handle and the second handle are compressed, the locking device releases allowing the deformable parallelogram to be deformed, thereby adjusting the height of the basketball backboard.

It is an object of the present invention to provide an adjustable height basketball apparatus which is easily adjusted.

It is another object of an embodiment of the present invention to provide an adjustable height basketball apparatus that is adjusted without the need for tools or equipment.

It is yet another object of the present invention to provide an adjustable height basketball apparatus that is maintained rigidly in place during operation.

These and other objects of the present invention will become readily apparent upon further review of the following specification and drawings. It is understood that both the foregoing general description and the following detailed description are exemplary and explanatory and are intended to provide further explanation of the invention as claimed.

The accompanying drawings are included to provide a further understanding of the invention and are incorporated in and constitute a part of this specification, illustrate several embodiments of the invention and, together with the description, serve to explain the principles of the invention.

BRIEF DESCRIPTION OF THE DRAWINGS

Similar reference characters denote corresponding features consistently throughout the attached drawings.

DETAILED DESCRIPTION OF THE PREFERRED EMBODIMENTS

Reference will now be made in detail to the present preferred embodiment of the invention, examples of which are illustrated in the accompanying drawings.

Figure 1:
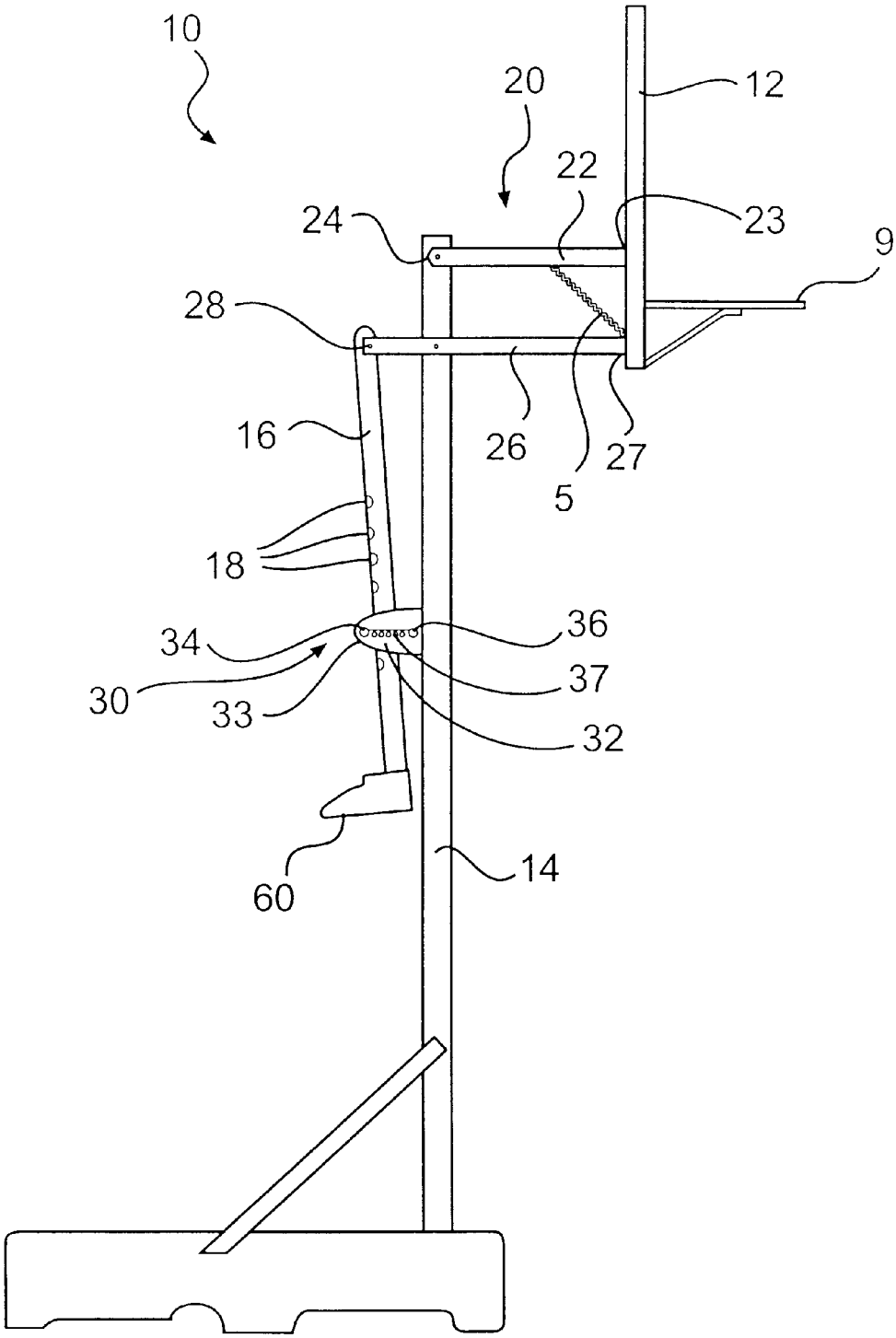
FIG. 1 is a side view of a first embodiment of an adjustable height basketball apparatus according to the present invention.

An exemplary embodiment of an adjustable height basketball apparatus is shown in FIGS. 1 and is designated generally by reference numeral 10. As embodied herein and referring to FIG. 1, the adjustable basketball apparatus 10 comprises a basketball backboard 12 with a basketball goal 9 attached thereto, a support member 14 or pole, and an upper arm 22 having a first end 23 and a second end 24, and a lower arm 26 having a first end 27 and a second end 28 for connecting the basketball backboard 12 to the support member 14. The backboard 12, support pole 14, upper arm 22, and lower arm 26 together form a deformable parallelogram 20. There is a linkage member 16 disposed between one of the upper arm 22 or the lower arm 26 and a locking device 30 for holding the basketball backboard 12 at a selected height. The linkage member 16 terminates in a first end 60 such that when a force is applied to the first end 60 in the direction of the support member 14, the locking device 30 releases, allowing movement of the linkage member 16 and allowing the deformable parallelogram 20 to be deformed, thereby adjusting the height of the basketball backboard 12.

The first end 23 of the upper arm 22 and the first end 27 of the lower arm 26 are pivotally connected to the basketball backboard 12. The upper arm 22 and the lower arm 26 are also pivotally connected to the support member 14. At least one of the upper arm 22 and the lower arm 26 are pivotally connected to the second linkage member. The upper arm 22 and the lower arm 26 each preferably comprise a pair of arms pivotally connected to opposite points on the support member 14. However, the upper arm 22 and the lower arm 26 may comprise a single arm.

The linkage member 16 comprises a plurality of grooves 18 along its length for engaging the locking device 30. It is preferable to have markings (not shown) beside each of the grooves 18 indicating the height of the basketball backboard 12 when each of the particular grooves 18 is engaged in the locking device 30.

It is preferred that the locking device 30 is coupled to the support member 14 and comprises a bracket 32 which could have free ends 33 facing outwardly from the support member 14, a retention member 34, and a detaining element 36. Although depicted as a substantially u-shaped bracket, it would be obvious for the bracket 32 to be any configuration which would allow the linkage member 16 to be displaced therein. The detaining element 36 is adapted to impart force upon the linkage member 16 in the direction of the retention member 34. The retention member 34 is adapted to communicate with one of the grooves 18 in the linkage member 16, thereby restricting deformation of the deformable parallelogram 20.

Figure 5:
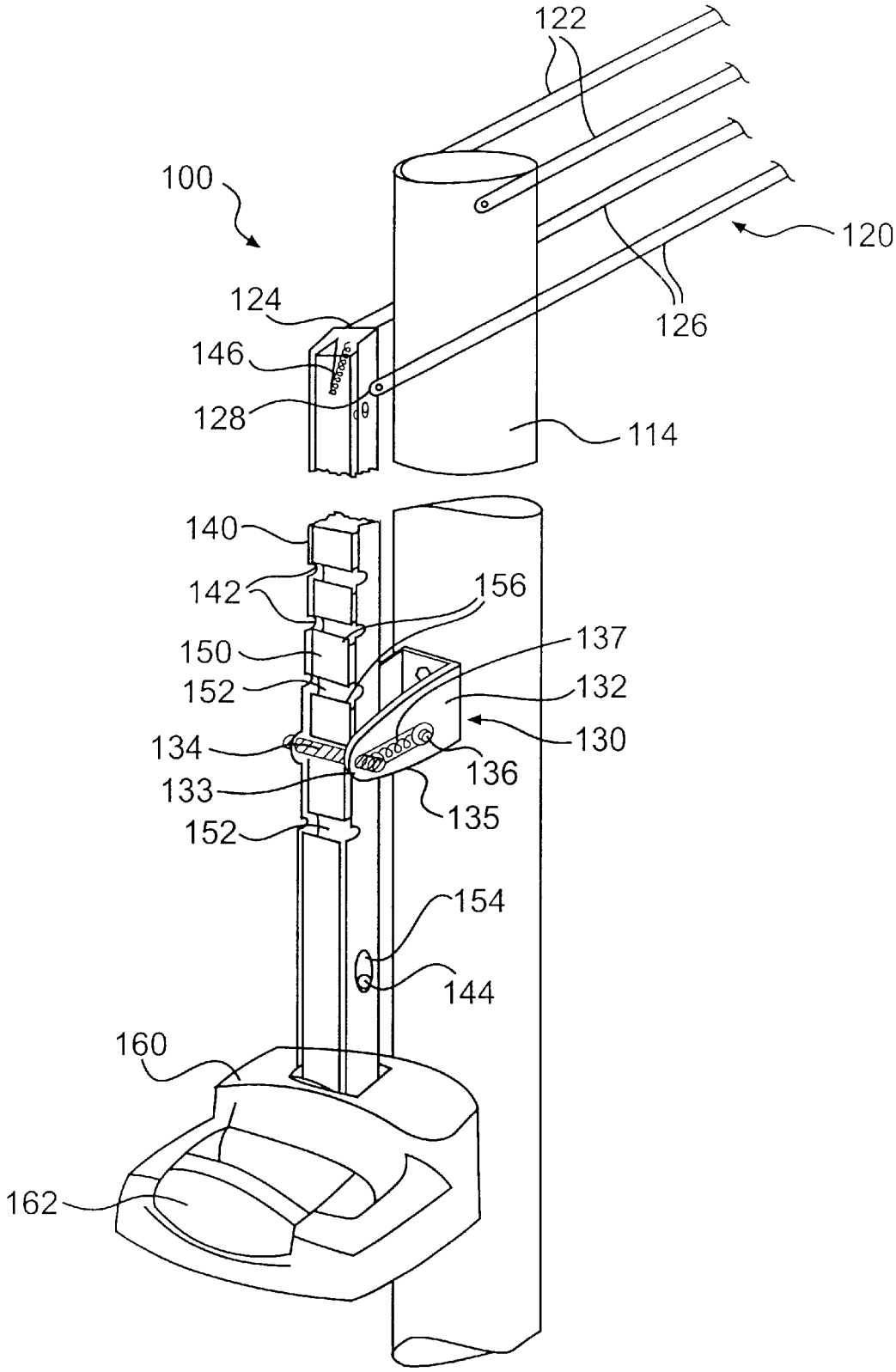
FIG. 5 is a perspective view of the apparatus according to FIG. 3 in an u locked position.

The retention member 34 preferably comprises a first pin 34 disposed substantially within the bracket 32. In an embodiment where the bracket 32 has free ends 33 the retention member is disposed between the free ends 33 of bracket 32. It is preferred that the first pin 34 be fixed in place in order to prevent loss of the pin and to provide a rigid structure. Alternatively, the first pin 34 may be a removable pin. Where the first pin 34 is removable, as depicted in FIG. 5, the linkage member 16 has holes 18*a* along its length for communication with the first pin 34 instead of the grooves 18. The detaining element 36 preferably comprises a second pin 36 disposed substantially within the unshaped bracket within opposing slits 35. There are one or more springs 37 for imparting force on the second pin 36 in the direction of the retention member 34. It is preferred that the springs 37 be attached to the first pin 34 as shown in the figures, but it would be obvious for it to be placed at any location where it could provide sufficient force against the linkage member 16 such that the retention member 34 remains engaged within the groove 18 during operation. Moreover, it would be obvious to one of ordinary skill in the art to use other methods of applying force against the linkage member.

In order to minimize the amount of force required to adjust the height of the basketball backboard 12, there is a counterbalance device 5 disposed between the basketball backboard 12 and either the upper arm 22 or the lower arm 26. The counterbalance device 5 resists downward motion of the basketball backboard 12, thereby requiring less force to be imparted by the user to adjust the height of the backboard 12. The counterbalance device 5 is preferably a spring, but may be any such device known to those of ordinary skill in the art such as elastic bands or the like.

In a preferred operation, the user pushes the first end 60 such that the detaining element 36 slides toward the support member 14 until the groove 18 is clear from the retention member 34. The linkage member 16 is then free to be raised and lowered. When the user selects a desired height, the linkage member 16 is allowed to be forced toward the retention member 34 and the groove 18 corresponding to the selected height engages the retention member 34, thereby securely holding the basketball apparatus 10 in place.

Figure 2:
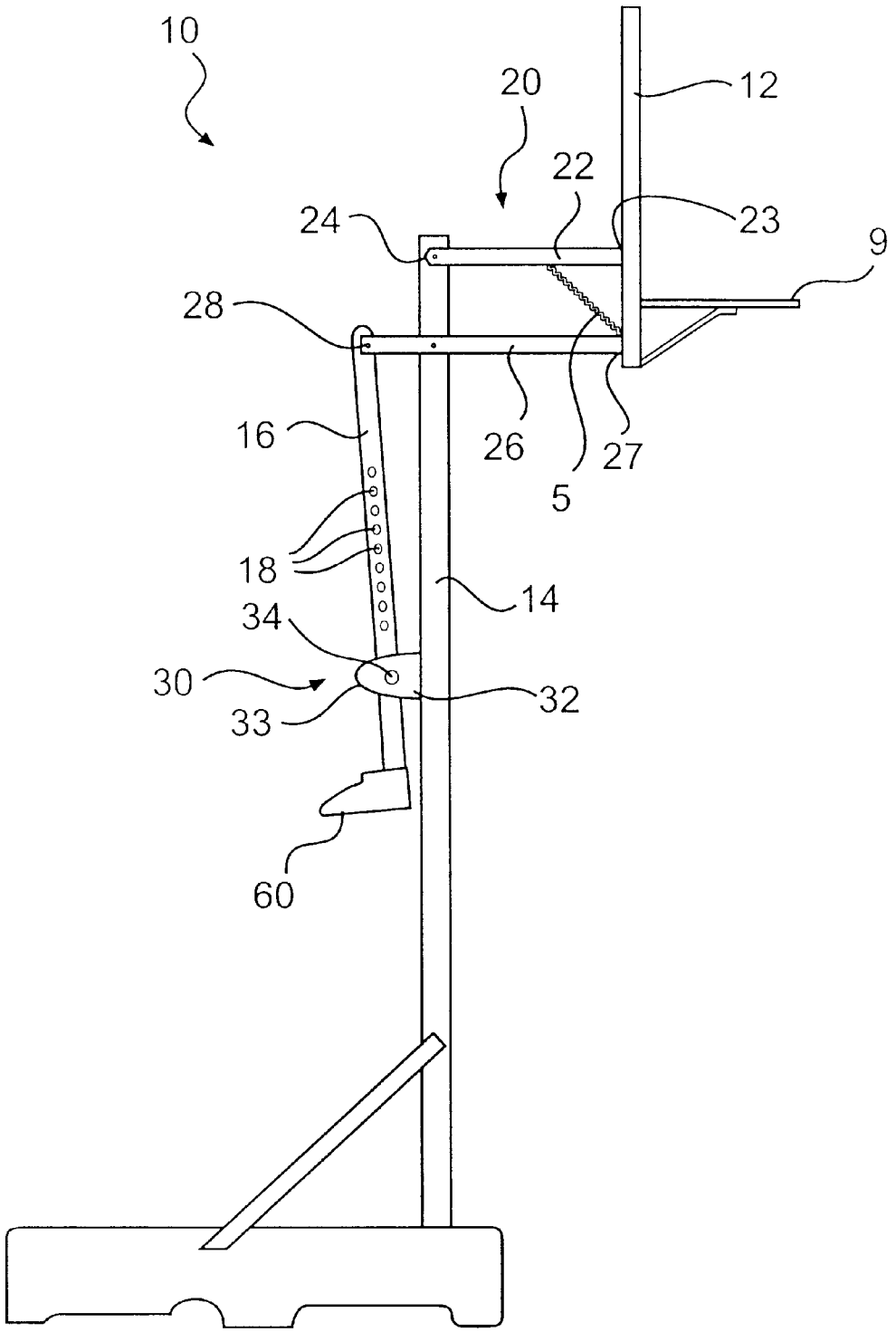
FIG. 2 is a side view of the embodiment shown in FIG. 1 incorporating a different locking device.
Figure 3:
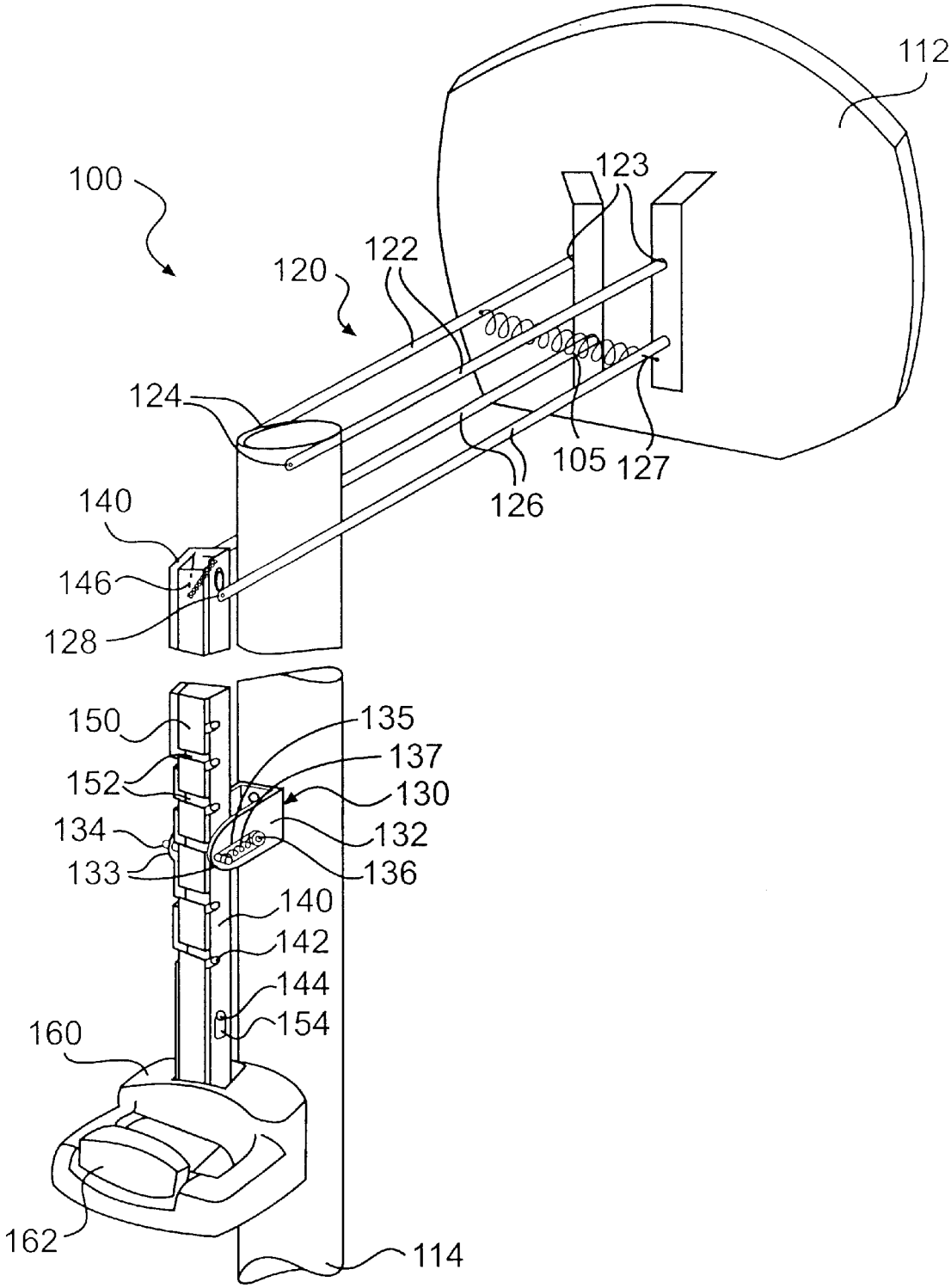
FIG. 3 is a perspective view of a second embodiment of an adjustable height basketball apparatus (in a locked position) according to the present invention.
Figure 4:
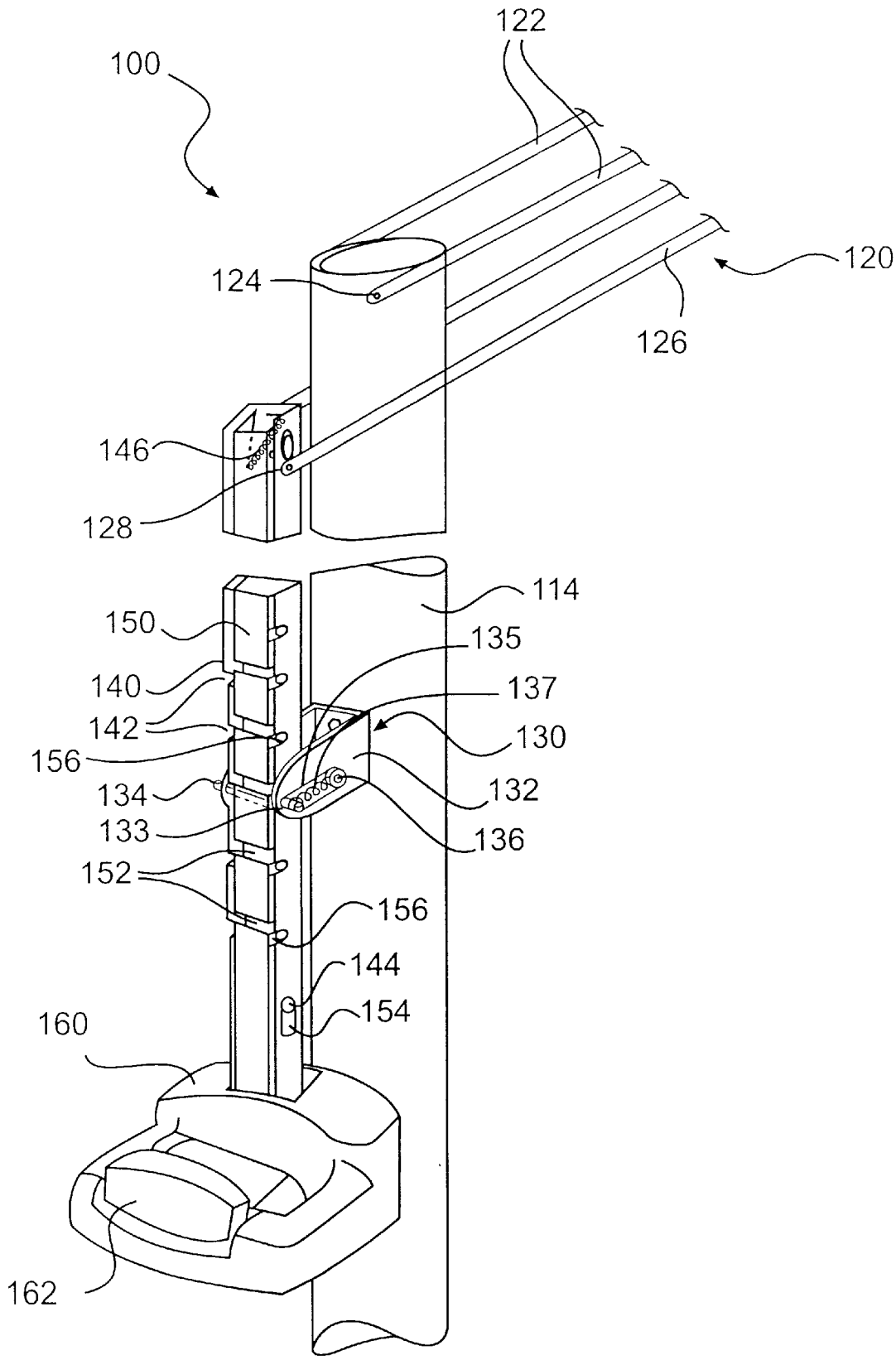
FIG. 4 is a close-up perspective view of a portion of the apparatus according to FIG. 3.

A second embodiment of the invention will now be described where like or similar parts are identified throughout the drawings by the same reference character. The second embodiment of an adjustable height basketball apparatus is shown in FIGS. 2–4 and is designated generally by reference numeral 100. As embodied herein and referring to FIGS. 2–4, the adjustable height basketball apparatus 100 comprises a basketball backboard 112, a support member 114, an upper arm 122 having a first end 123 and a second end 124, and a lower arm 126 having a first end 127 and a second end 128 for connecting the basketball backboard 112 to the support member 114. The backboard 112, support pole 114, upper arm 122, and lower arm 126 together form a deformable parallelogram 120. The linkage member 16 described above comprises a connecting rod 140 disposed between one of the upper arm 122 and the lower arm 126 and a locking device 130 for holding the basketball backboard 112 at a selected height. An inner bracket 150 extends along the connecting rod 140 for preventing disengagement of the locking device 130. The connecting rod 140 terminates in a first handle 160 and the inner bracket 150 terminates in a second handle 162. When the first handle 160 and the second handle 162 are compressed, the locking device 130 releases allowing the deformable parallelogram 120 to be deformed, thereby adjusting the height of the basketball backboard 112. In operation, the first handle 160 is fixed relative to the second handle 162. When the second handle 162 is depressed the inner bracket 150 is displaced relative to the connecting rod 140.

It is preferred that the first end 123 of the upper arm 122 and the first end 127 of the lower arm 126 are pivotally connected to the basketball backboard 112. The upper arm 122 and the lower arm 126 are pivotally connected to the support member 114. At least one of the upper arm 122 or the lower arm 126 are pivotally connected to the connecting rod 140. The connecting rod 140 comprises a plurality of grooves 142 along its length and the inner bracket 150 comprises a plurality of notches 152 along its length. It is preferable to have markings (not shown) beside each of the grooves 142 indicating the height of the basketball backboard 112 when each of the particular grooves 142 is engaged in the locking device 130.

The locking device 130 is attached to the support member 114 and preferably comprises a bracket 132 which could have free ends 133 facing outwardly from the support member 114, a retention member 134, and a detaining element 136 for imparting force upon said connecting rod 140 in the direction of said retention member 134. Although depicted as a substantially unshaped bracket, it would be obvious for the bracket 132 to be any configuration which would allow the connecting rod 140 and the inner bracket 150 to be displaced therein. The retention member 134 is adapted to communicate with the notches 152 in the inner bracket 150 and the grooves 142 in the connecting rod 140. When the notches 152 are in registry with the grooves 142, the connecting rod 140 and the inner bracket 150 are adapted to communicate with the retention member 134, thereby restricting deformation of the deformable parallelogram 120.

The retention member 134 preferably comprises a first pin 134 disposed substantially within the bracket 132. In an embodiment where the bracket 132 has free ends 133, the retention member 134 is disposed between the free ends 133 of bracket 132. It is preferred that the first pin 134 be fixed in place in order to prevent loss of the pin and to provide a rigid structure. The detaining element 136 preferably comprises a second pin 136 disposed within the bracket 132 within opposing slits 135. There are one or more springs 137 for imparting force on the second pin 136 in the direction of the retention member 134. The second pin 136 abuts the connecting rod 140 such that the retention member 134 is maintained substantially within a notch 152 in the inner bracket 150 and a groove 142 in the connecting rod 140.

It is desirable for the connecting rod 140 to comprise one or more pegs 144 for communicating with slots 154 defined in the inner bracket 150, thereby restricting movement of the inner bracket 150 relative to the connecting rod 140. There is a spring 146 connecting the connecting rod 140 and the inner bracket 150 such that the default position of the inner bracket 150 is elevated and one is required to depress the second handle 162 towards the first handle 160 in order to lower the inner bracket 150. It is also desirable to have a counterbalance device 105 disposed between the basketball backboard 112 and either the upper arm 122 or the lower arm 126 in order to reduce the amount of force required to raise and lower the basketball backboard 112. The counterbalance device 105 is preferably a spring, but may be any such device known to those of ordinary skill in the art such as elastic bands or the like.

It is also desirable for the inner bracket 150 to have a lip member 156 adjacent each notch 152 to prevent the inner bracket 150 and the connecting rod 140 from becoming disengaged from the retention member 134 in the locking device 130. When the second handle 162 is depressed, the inner bracket 150 slides along the length of the connecting rod 140 and the lip member 156 is displaced below the retention member 134 thereby allowing the connecting rod 140 and inner bracket 150 to disengage from the locking device 130.

In operation, after compressing the second handle 162 such that the lip member 156 is displaced below the retention member 134, the user applies force against the handles 160, 162 such that the detaining element 136 slides toward the support member 114 until the connecting rod 140 and inner bracket 150 are clear from the retention member 134 and are free to be raised and lowered. When the user selects a desired height, the connecting rod 140 and inner bracket 150 are allowed to be forced back toward the retention member 134 and the groove 142 and notch 152 corresponding to the selected height engage the retention member 134. The first and second handles 160, 162 are then released thereby allowing the inner bracket 150 to return to its elevated default position and the lip member 156 to be replaced to a position above the retention member 134, ultimately holding the basketball apparatus 100 rigidly in place.

It will be apparent to those skilled in the art that various modifications and variations can be made in an adjustable height basketball apparatus of the present invention without departing from the spirit or scope of the invention. Thus, it is intended that the present invention cover the modifications and variations of this invention provided they come within the scope of the appended claims and their equivalents.

What is claimed is:

1. An adjustable basketball apparatus comprising:

a basketball backboard;

a basketball goal coupled to the basketball backboard;

a support member;

an upper arm and a lower arm connecting the basketball backboard to the support member which, wherein said upper and lower arms together with the basketball backboard and the support member define a rotateable parallelogram;

a locking device for holding the basketball backboard at a selected height, said locking device connected to said support member and having:

a bracket;

a retention member having a first pin disposed substantially within said bracket; and a detaining element for imparting force upon said linkage member generally in the direction of said retention member, said detaining element including a second pin disposed substantially within said bracket and engaging opposing slits and at least one spring for imparting force on said second pin generally in the direction of said retention member;

a linkage member at least partially disposed between said locking device and at least one of said upper and lower arms operable to rotate the rotateable parallelogram thereby changing the height of the backboard, said linkage member having a plurality of height adjustment apertures; and an adjustment mechanism operable to adjust the height of the backboard by releasing said locking device, thus permitting movement of said linkage member allowing the rotateable parallelogram to be rotated;

wherein said retention member is adapted to communicate with said height adjustment apertures, thereby preventing substantial movement of said linkage member.

2. An adjustable basketball apparatus comprising:

a basketball backboard;

a basketball goal coupled to the basketball backboard;

a support member;

an upper arm and a lower arm connecting the basketball backboard to the support member which, wherein said upper and lower arms together with the basketball backboard and the support member define a rotateable parallelogram;

a locking device for holding the basketball backboard at a selected height, said locking device connected to said support member and having:

a bracket; and a retention member;

a linkage member at least partially disposed between said locking device and at least one of said upper and lower arms operable to rotate the rotateable parallelogram thereby changing the height of the backboard, said linkage member having:

a plurality of height adjustment apertures;

a connecting rod at least partially disposed between said locking device and one of said upper and lower arms for adjusting the height of said basketball backboard; and an inner bracket extending along at least a portion of the length of said connecting rod for preventing disengagement of said locking device;

an adjustment mechanism operable to adjust the height of the backboard, said adjustment mechanism comprising a first handle and a second handle, wherein said connecting rod terminates in the first handle and said inner bracket terminates in the second handle such that when said first handle and said second handle are forced together, said locking device releases allowing movement of said connecting rod and said inner bracket and allowing said rotateable parallelogram to be rotated, thereby adjusting the height of the basketball backboard;

wherein said retention member is adapted to communicate with said height adjustment apertures, thereby preventing substantial movement of said linkage member.

3. The apparatus according to claim 2, wherein said locking device is coupled to said support member and further comprises:

a detaining element for imparting force upon said connecting rod generally in the direction of said retention member;

wherein said retention member is adapted to communicate with at least one of said plurality of notches in said inner bracket and at least one of a plurality of grooves in said connecting rod, such that when the notches are in registry with the grooves, said connecting rod and said inner bracket are positioned to engage said retention member thereby restricting movement of said linkage member and rotation of said rotateable parallelogram.

4. The apparatus according to claim 3, wherein said retention member comprises a first pin disposed substantially within said bracket of said locking device and said detaining element comprises:

a second pin disposed substantially within said bracket of said locking device within opposing slits; and at least one spring for imparting force on said second pin in the direction of said retention member.

5. The apparatus according to claim 3, wherein said inner bracket further comprises a lip member adjacent each said notch to prevent said inner bracket and said connecting rod from becoming disengaged from said locking device when said first handle and said second handle are not compressed, and when said first handle and said second handle are forced together, said lip member is displaced below said retention member thereby allowing disengagement from said locking device.

6. The apparatus according to claim 5, wherein said connecting rod comprises at least one peg for communicating with slots in said inner bracket, thereby restricting movement of said inner bracket relative to said connecting rod.

7. The apparatus according to claim 5, wherein said inner bracket is coupled to said connecting rod by a retention spring such that said lip member is elevated above said retention member in a default position.

8. The apparatus according to claim 2, wherein said first handle and said second handle are biased apart from each other.

9. An adjustable basketball apparatus comprising:

a basketball backboard;

a basketball goal coupled to the basketball backboard;

a support member;

an upper arm and a lower arm connecting the basketball backboard to the support member which, wherein said upper and lower arms together with the basketball backboard and the support member define a rotateable parallelogram;

a locking device for holding the basketball backboard at a selected height, said locking device connected to said support member and having:

a bracket; and a retention member;

a linkage member at least partially disposed between said locking device and at least one of said upper and lower arms operable to rotate the rotateable parallelogram thereby changing the height of the backboard, said linkage member including a plurality of height adjustment apertures having a plurality of notches defined along the length of said linkage member; and an adjustment mechanism operable to adjust the height of the backboard by releasing said locking device, thus permitting movement of said linkage member allowing the rotateable parallelogram to be rotated;

wherein said retention member is adapted to communicate with said height adjustment apertures, thereby preventing substantial movement of said linkage member.

10. An adjustable basketball apparatus comprising:

a basketball backboard;

a basketball goal coupled to the basketball backboard;

a support member;

an upper arm and a lower arm connecting the basketball backboard to the support member which, together with the basketball backboard and the support member form a rotateable parallelogram;

a linkage member disposed between at least one of said upper and lower arm;

a locking device for holding the basketball backboard at a selected height, said locking device connected to said support member and having:

a bracket;

a retention member; and a detaining element for imparting force upon said linkage member generally in the direction of said retention member;

wherein said retention member comprises a first pin disposed substantially within said bracket, and wherein said detaining element further comprises:

a second pin disposed substantially within said bracket within opposing slits; and one or more springs for imparting force on said second pin in the direction of said retention member.

11. An adjustable basketball apparatus comprising:

a basketball backboard;

a basketball goal coupled to the basketball backboard;

a support member;

an upper arm and a lower arm connecting the basketball backboard to the support member which, together with the basketball backboard and the support member form a deformable parallelogram;

a locking device for holding the basketball backboard at a selected height;

a linkage member disposed between at least one of said upper and lower arm, said linkage member comprising:

a connecting rod disposed between one of the upper arm and lower arm and said locking device for holding the basketball backboard at a selected height; and an inner bracket extending along said connecting rod for preventing disengagement of said locking device;

wherein said connecting rod terminates in a first handle and said inner bracket terminates in a second handle such that when said first handle and said second handle are compressed, said locking device releases allowing movement of said connecting rod and said inner bracket and allowing said deformable parallelogram to be deformed, thereby adjusting the height of the basketball backboard.

12. The apparatus according to claim 11, wherein the upper arm comprises a first end and a second end, and wherein the lower arm comprises a first end and a second end, and wherein the first end of the upper arm is pivotally connected to the backboard, and wherein the first end of the lower arm is pivotally connected to the backboard, and wherein the upper and the lower arms are pivotally connected to the support member, and wherein at least one of the upper and lower arms is pivotally connected to said connecting rod, and wherein said locking device is coupled to the support member and comprises:

an outer bracket;

a retention member; and a detaining element for imparting force upon said connecting rod in the direction of said retention member;

wherein said retention member is adapted to communicate with at least one of a plurality of notches in said inner bracket and at least one of a plurality of grooves in said connecting rod, such that when the notches are in registry with the grooves, said connecting rod and said inner bracket being adapted to enclose said retention member thereby restricting deformation of said deformable parallelogram; and wherein said inner bracket further comprises a lip member adjacent each said notch to prevent said inner bracket and said connecting rod from becoming disengaged from said locking device when said first handle and said second handle are not compressed, and when said first handle and said second handle are compressed, said lip member is displaced below said retention member thereby allowing disengagement from said locking device.

13. The apparatus according to claim 12, wherein said connecting rod comprises one or more pegs for communicating with slots in said inner bracket, thereby restricting movement of said inner bracket relative to said connecting rod.

14. The apparatus according to claim 12, wherein said inner bracket is couple d to said connecting rod by a retention spring such that said lip member is elevated above said retention member in a default position.

* * * * *